US006957709B2

(12) United States Patent
Meister et al.

(10) Patent No.: US 6,957,709 B2
(45) Date of Patent: Oct. 25, 2005

(54) APPARATUS AND METHOD FOR CLEANING AND SEALING A WELL BOREHOLE PORTION FOR FORMATION EVALUATION

(75) Inventors: Matthias Meister, Celle (DE); Wolfgang Herberg, Bergen (DE); Sven Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/772,123

(22) Filed: Feb. 4, 2004

(65) Prior Publication Data

US 2004/0238220 A1 Dec. 2, 2004

Related U.S. Application Data

(62) Division of application No. 10/279,415, filed on Oct. 24, 2002, now Pat. No. 6,763,884.

(51) Int. Cl.[7] ..... E21B 12/00; E21B 49/00; E21B 49/06

(52) U.S. Cl. ..... 175/50; 166/100; 166/222; 73/152.43

(58) Field of Search ..... 166/100, 222, 166/223; 175/50, 57–60; 73/152.43

(56) References Cited

U.S. PATENT DOCUMENTS

| | | | | |
|---|---|---|---|---|
| 2,959,397 | A | 11/1960 | Gardner et al. | 255/1.4 |
| 3,782,191 | A * | 1/1974 | Whitten | 73/152.25 |
| 4,339,948 | A * | 7/1982 | Hallmark | 73/152.26 |
| 4,416,152 | A | 11/1983 | Wilson | 73/155 |
| 4,470,456 | A * | 9/1984 | Moutray, III | 166/100 |
| 4,951,749 | A | 8/1990 | Carroll | 166/264 |
| 5,056,595 | A | 10/1991 | Desbrandes | 166/100 |
| 6,006,834 | A * | 12/1999 | Skinner | 166/250.17 |

* cited by examiner

*Primary Examiner*—John Kreck
(74) *Attorney, Agent, or Firm*—Madan, Mossman & Sriram, P.C.

(57) ABSTRACT

A borehole wall cleaning apparatus and method for obtaining an improved seal between a fluid sampling device and a portion of the borehole wall. Clean drilling fluid is pumped into a drilling tool using a mud pump. A fluid diverter in the tool diverts all or part of the clean drilling fluid through a port to clear a portion of a borehole wall. A sealing pad is moved against the clean portion. A sampling port is exposed to the sealed portion for sampling and/or testing fluid from the formation.

16 Claims, 8 Drawing Sheets

APPARATUS AND METHOD FOR CLEANING AND SEALING A WELL BOREHOLE PORTION FOR FORMATION EVALUATION

CROSS REFERENCES TO RELATED APPLICATIONS

This application is a divisional of U.S. patent application Ser. No. 10/279,415 filed on Oct. 24, 2002, now U.S. Pat. No. 6,763,884.

BACKGROUND OF THE INVENTION

1. Field of the Invention

This invention generally relates to the testing of underground formations or reservoirs, and more particularly to an apparatus and method for effecting a cleaned and sealed well borehole wall portion for improved formation fluid sampling from a formation surrounding the wall portion.

2. Description of the Related Art

Formation testing while drilling ("FTWD") is a form of formation evaluation that incorporates aspects of wireline logging into a drilling operation. Today, well boreholes are drilled by rotating a drill bit attached at a drill string end. The drill string may be a jointed rotatable pipe or a coiled tube. A large portion of the current drilling activity involves directional drilling, i.e., drilling boreholes deviated from vertical and/or horizontal boreholes, to increase the hydrocarbon production and/or to withdraw additional hydrocarbons from earth formations. Modem directional drilling systems generally employ a drill string having a bottomhole assembly (BHA) and a drill bit at an end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional downhole instruments, known as measurement-while-drilling (MWD) or logging-while-drilling (LWD) tools, are frequently attached to the drill string to determine formation geology and formation fluid conditions during the drilling operations. For the purposes of the present invention, the term Formation Testing While Drilling ("FTWD") includes, but is not necessarily limited to MWD and LWD tests.

Various types of drilling fluids are used to facilitate the drilling process and to maintain a desired hydrostatic pressure in the borehole. Pressurized drilling fluid (commonly known as the "mud" or "drilling mud") is pumped into a drill pipe through a central bore to rotate the drill motor and to provide lubrication to various members of the drill string including the drill bit. The mud exits the drill string at the drill bit and returns to the surface in the annular space between the drill string and the borehole wall carrying formation debris ("cuttings") pulverized by the rotating drill bit. The term ("return fluid") is used herein to mean fluid comprising drilling fluid, formation fluid and cuttings returning to the surface or otherwise existing in the annulus. The terms drilling fluid, mud, clean fluid or the like are used to mean fluid in the drill string and/or fluid in close relation to any exit port of the drill string and substantially free of cuttings. Such clean fluid may be drilling fluid pumped from a surface location or any substantially clean fluid in the tool.

The clean drilling fluid, typically mixed with additives at the surface, is also used to protect downhole components from corrosion, and to maintain a specified density based on known or expected formation pressure. The return fluid in the annulus is typically maintained at a pressure slightly higher than the surrounding formation. The annular pressure is reduced during certain testing operations that require production of formation fluid.

Several FTWD operations involve producing fluid from the reservoir by, for example, sealing a portion of the borehole and collecting samples of fluid from the formation. Well-known devices such as packers, snorkel probes and extendable pads are typically used to effect a seal at the borehole wall thereby separating the annulus into at least two portions, i.e. one portion being a sealed portion containing formation fluid for testing and at least one more annular portion containing mostly return drilling fluid.

Whenever the sealing device fails to maintain a good seal, the sealed portion may become contaminated with return fluid or pressure control within the sealed portion becomes unmanageable due to pressure communication between the sealed portion and the rest of the annulus.

A common cause sealing problems is the existence of cuttings in the return fluid. As a sealing device is moved to engage the borehole wall, cuttings or thick mud layers are trapped between the sealing device and wall or trapped within the sealed portion. In the former instance the seal is poor, thereby allowing leakage across the seal. In the latter instance cuttings debris can clog the sampling tool or otherwise corrupt the test. The cuttings might also become lodged within a sampling port causing damage or loss of sampling capability.

When starting to pump formation fluid through the sealed portion the mud layer is removed first and enters the formation testing device as well as the formation fluid. The mud contaminates the sample and makes the determination of certain formation parameter more difficult or even impossible.

SUMMARY OF THE INVENTION

The present invention addresses some of the drawbacks discussed above by providing a measurement while drilling apparatus and method which enables improved sampling and measurements of parameters of fluids contained in a borehole by cleaning a portion of the borehole wall just as a sealing device is moved to seal the cleaned portion.

In one aspect of the present invention, a method of sampling fluid from a formation is provided. The method includes conveying a tool in a well borehole surrounded by the formation a fluid, such as drilling fluid is delivered through the tool using a fluid moving device located at a surface location. During drilling, the drilling fluid exits the tool at a distal end and returns to the surface as return fluid in an annulus between the tool and a borehole wall; the return fluid thus includes the drilling fluid and formation fragments. The drilling fluid is directed from within the tool toward a portion of the borehole wall to divert the fragments in the return fluid away from the wall portion and to reduce the thickness of the mud layer at the borehole wall. A pad member is moved to the wall portion to seal the wall portion from the annulus. A sampling port is then exposed to the sealed wall portion to sample formation fluid from the formation.

In another aspect of the present invention an apparatus is provided for cleaning a portion of borehole wall. The tool is disposed in a well borehole and an annulus surrounds the tool. The annulus includes a return fluid comprising fragments of formation. The tool includes a clean fluid within the tool, the clean fluid exiting the tool at a distal end and returning as a return fluid to the surface location in an annulus between the tool and a borehole wall, the return fluid including the first fluid and formation fragments. The tool includes a fluid-diverting device for directing the clean fluid from within the tool toward a portion of the borehole wall for diverting the fragments in the return fluid away from the wall portion and for reducing the thickness of the mud layer at the borehole wall. The tool also includes a pad member disposed on the tool, the pad member being moveable in relation to the wall portion for sealing said wall portion from the annulus. A sampling port in the tool is exposed to the sealed wall portion for sampling formation fluid.

In yet another aspect of the invention, a system for formation testing while drilling is provided. The system includes a well drilling rig adapted to convey a drill string into the earth for drilling a well borehole. A surface pump is coupled to the drill string to convey drilling fluid into the drill string. The system includes a sampling tool for sampling formation fluid during drilling. The tool includes a clean fluid within the tool, the clean fluid exiting the tool at a distal end and returning as a return fluid to the surface location in an annulus between the tool and a borehole wall, the return fluid including the first fluid and formation fragments. The tool includes a fluid-diverting device for directing the clean fluid from within the tool toward a portion of the borehole wall for diverting the fragments in the return fluid away from the wall portion and for reducing the thickness of the mud layer at the borehole wall. The tool also includes a pad member disposed on the tool, the pad member being moveable in relation to the wall portion for sealing said wall portion from the annulus. A sampling port in the tool is exposed to the sealed wall portion for sampling formation fluid. A surface controller is coupled to the drilling rig for controlling drilling operations and the tool.

BRIEF DESCRIPTION OF THE DRAWINGS

The novel features of this invention, as well as the invention itself, will be best understood from the attached drawings, taken along with the following description, in which similar reference characters refer to similar parts and wherein.

DESCRIPTION OF PREFERRED EMBODIMENTS

Figure 1:
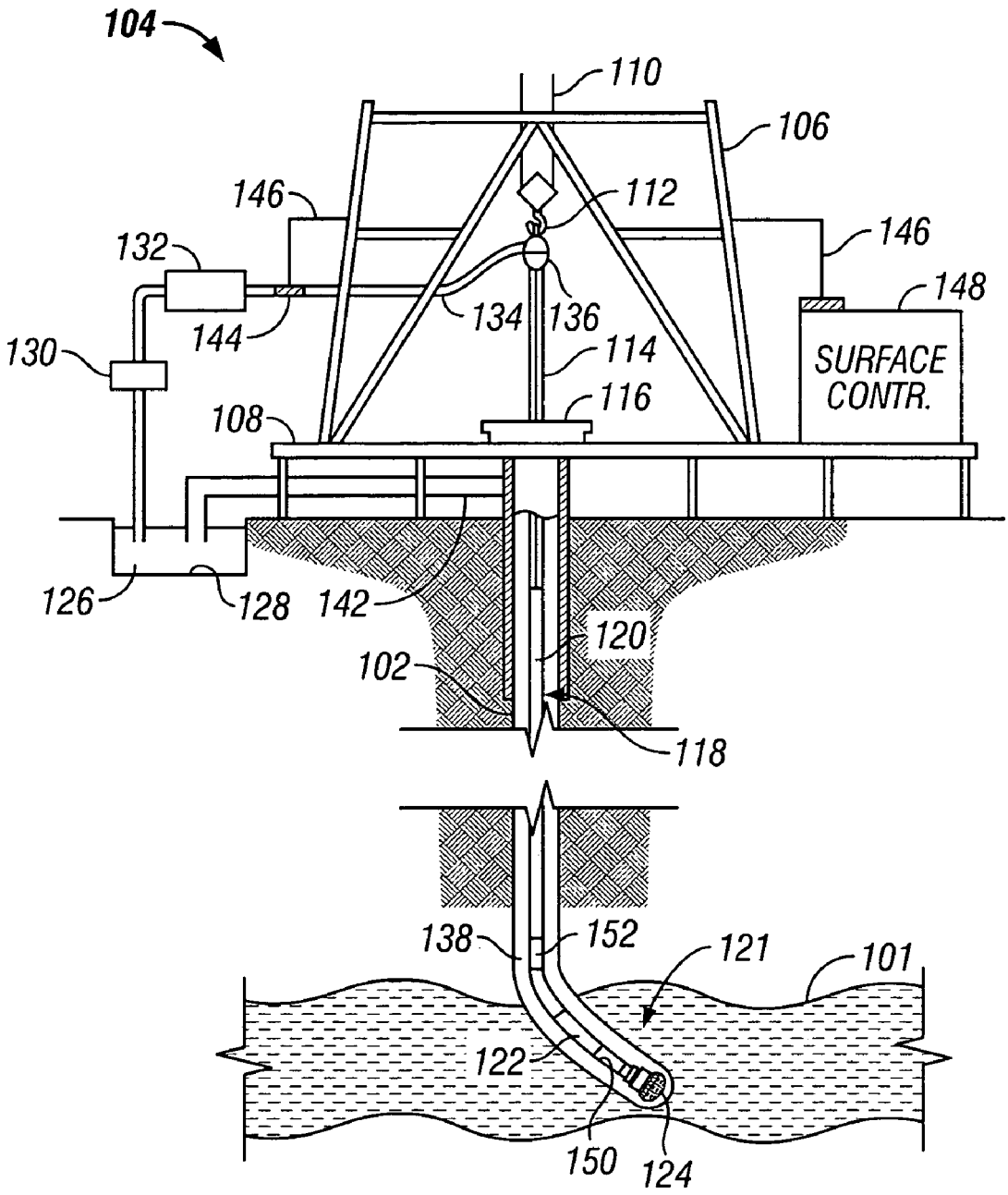
FIG. 1 is an elevation view of a typical well drilling system incorporating the present invention.

FIG. 1 is an elevation view of a simultaneous drilling and logging system that incorporates an embodiment of the present invention. A well borehole 102 is drilled into the earth under control of surface equipment including a rotary drilling rig 104. In accordance with a conventional arrangement, rig 104 includes a derrick 106, derrick floor 108, draw works 110, hook 112, kelly joint 114, rotary table 116, and drill string 118. The drill string 118 includes drill pipe 120 secured to the lower end of the kelly joint 114 and to the upper end of a section comprising a plurality of drill collars. The drill collars include not separately shown drill collars such as an upper drill collar, an intermediate sub drill collar, and a lower drill collar bottom hole assembly (BHA) 121 immediately below the intermediate sub. The lower end of the BHA 121 carries a downhole tool 122 of the present invention and a drill bit 124.

Clean drilling fluid 126 is circulated from a mud pit 128 through a mud pump 130, past a desurger 132, through a mud supply line 134, and into a swivel 136. The clean drilling fluid 126 flows down through the kelly joint 114 and a longitudinal central bore in the drill string, and through jets (not shown) in the lower face of the drill bit. Return fluid 138 containing drilling mud, cuttings and formation fluid flows back up through the annular space between the outer surface of the drill string and the inner surface of the borehole to be circulated to the surface where it is returned to the mud pit through a mud return line 142. A shaker screen (not shown) separates formation cuttings from the drilling mud before the mud is returned to the mud pit.

The system in FIG. 1 may use any conventional telemetry methods and devices for communication between the surface and downhole components. In the embodiment shown mud pulse telemetry techniques are used to communicate data from down hole to the surface during drilling operations. To receive data at the surface, there is a transducer 144 in mud supply line 132. This transducer generates electrical signals in response to drilling mud pressure variations, and a surface conductor 146 transmits the electrical signals to a surface controller 148.

If applicable, the drill string 118 can have a downhole drill motor 150 for rotating the drill bit 124. Incorporated in the drill string 118 above the drill bit 124 is the downhole tool 122 of the present invention, which will be described in greater detail hereinafter. A telemetry system 152 is located in a suitable location on the drill string 118 such as above the tool 122. The telemetry system 152 is used to receive commands from, and send data to, the surface via the mud-pulse telemetry described above.

Figure 2:
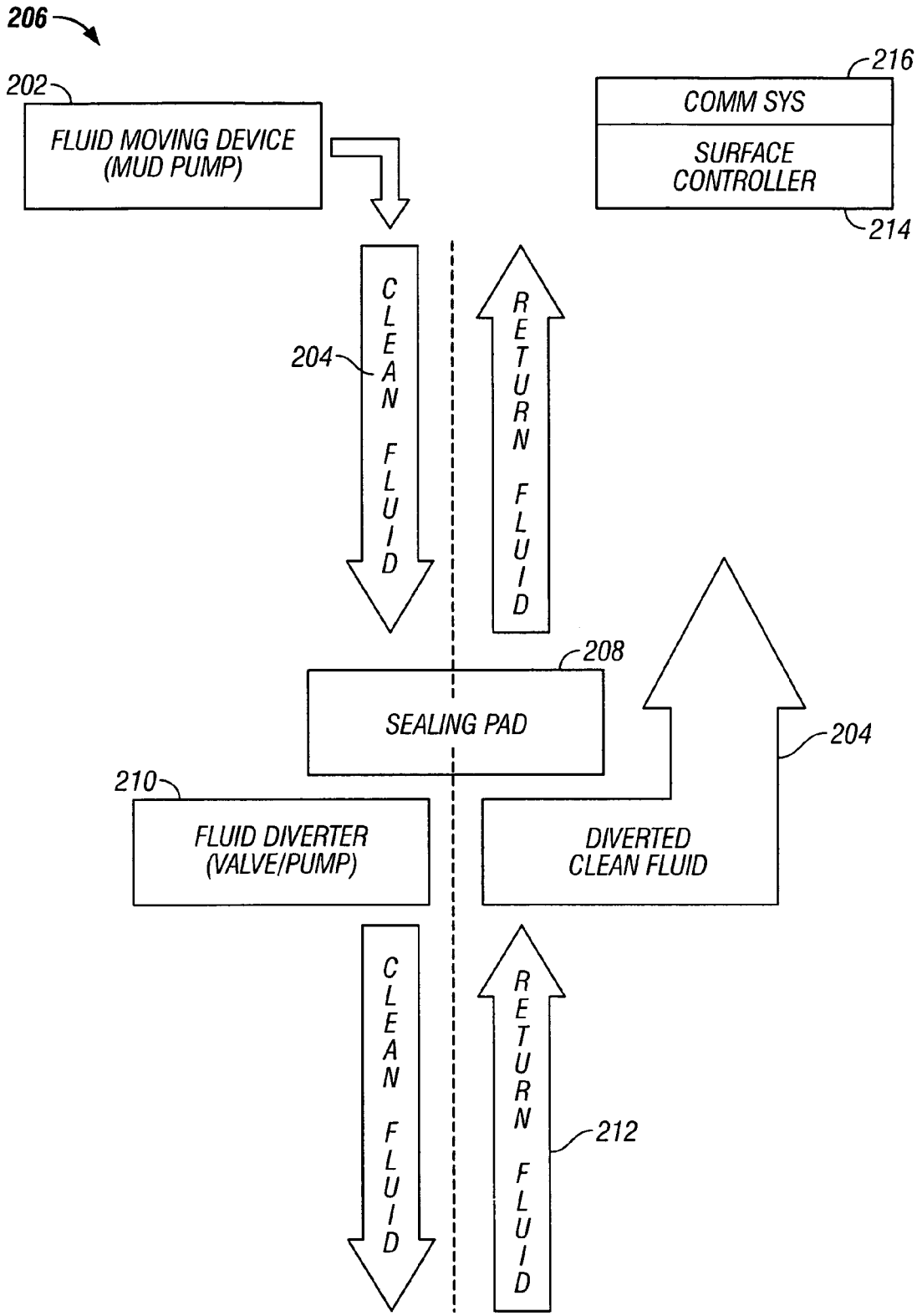
FIG. 2 is a functional flow of a system according to the present invention.

FIG. 2 is a functional flow of a system 200 according to the present invention. A fluid moving device 202 is used to convey clean fluid 204 through a tool 206 according to the present invention. The tool 206 includes a sealing pad 208 for sealing a portion of a borehole wall and a fluid diverter 210 for diverting the clean fluid toward the borehole wall portion.

Directing clean fluid toward the borehole wall where the sealing pad will ultimately seal clears the area of debris, such as formation fragments ("cuttings") and mud layers. These cuttings are usually suspended by and/or flowing in return fluid 212 existing in the annulus between the tool and wall.

In a preferred embodiment, the system includes a surface controller 214 and a communication system 216. The surface controller is preferably a typical surface controller that includes a processor, user interface, storage devices and output devices. One such controller is a common desktop computer system that includes programmed instructions for use in drilling operations and in formation testing. The surface controller is coupled to the downhole tool by known methods and devices and communicates via the communication system. The communication system can be any well-known system used for communicating data signals between a surface controller and a downhole tool such as the tool of the present invention.

The fluid moving device 202 is preferably a typical mud pump used to flow drilling fluid ("mud") through a drilling tool. In some cases the fluid moving device can be a pump dedicated for the purpose of directing fluid toward the borehole wall, while a primary pump is used for flowing fluid through the tool to exit at a drill bit (not shown).

Figure 3:
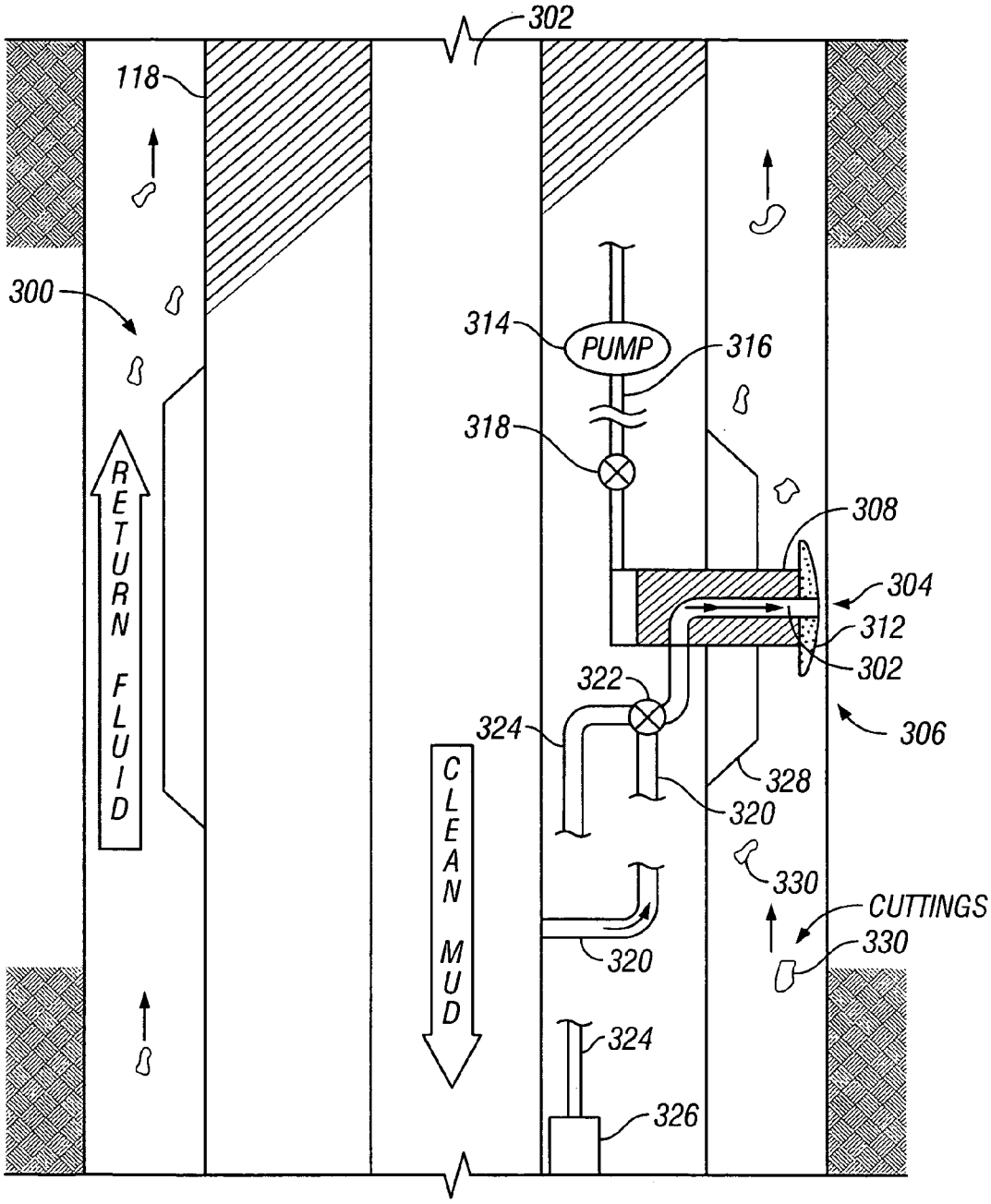
FIG. 3 is a cross section of one embodiment of the present invention.

FIG. 3 is a partial cross section of one embodiment of the present invention. For clarity, components described above and shown in FIG. 1 are not reproduced in FIG. 3 or described in detail here. FIG. 3 provides a focused view of one embodiment of the present invention wherein clean fluid 302 is directed toward a borehole wall portion through a port 304 that is also used as a formation fluid sampling port.

Shown is a tool 300 disposed within a well borehole adjacent a fluid-bearing formation. The tool 300 of this embodiment includes an extendable probe 306 located on a stabilizer 328. Those skilled in the art would recognize that a stabilizer is useful in keeping the drill string generally centered in the borehole. The extendable probe 306 includes a piston 308 movable within a piston chamber 310 and a sealing pad 312 coupled to an end of the piston 308, such an extendable probe is generally known in the art. The tool 300 of this embodiment includes a pump 314 for extending and retracting the piston 308, a flow line 316 connecting the pump 314 to the piston chamber 310, and a valve ("piston valve") 318 for controlling flow through the flow line.

The embodiment of FIG. 3 includes a flow line 320 coupling an internal flow path to the piston through a multi-position valve 322. The position of the multi-position valve 322 is selectable by command from the surface controller (see FIG. 1 at 148). A selected valve position allows, for example, clean fluid to flow through the valve to exit through the sampling port 304 to clean the borehole wall in the area a seal is desired. In another selected position the valve 302 blocks the clean fluid from flowing through the probe 308 and allows formation fluid to enter the port. Formation fluid flows through another flow line 324 to a sample and/or test chamber 326. A number of multi-position valve types useful for controlling fluid flow are known, and thus need not be described in detail here.

The coupling between the clean fluid flow line 320 and the probe 306 flow path is preferably a sealed union when the probe moves through the area of coupling. The diameter of the flow line 320 is preferably larger than the diameter of the flow path to allow continued flow through the coupling that as the probe extends to seal against the borehole wall. Continued probe movement with fluid flow can also be obtained by coupling the flow line 320 to the probe flow path using a flexible conduit (not shown) housed in the piston chamber.

Figure 3C:
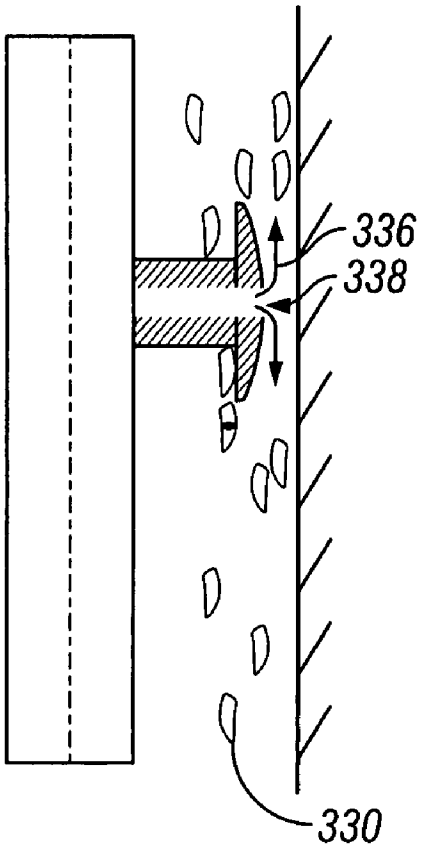
FIGS. 3A–3C represent a method according to the present invention.
Figure 3B:
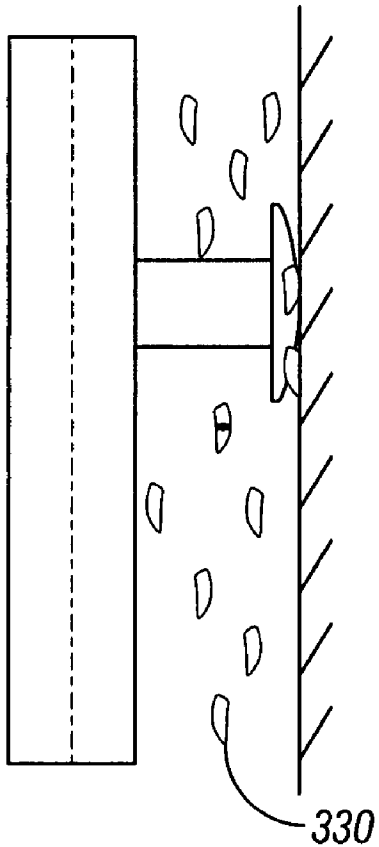
Figure 3A:
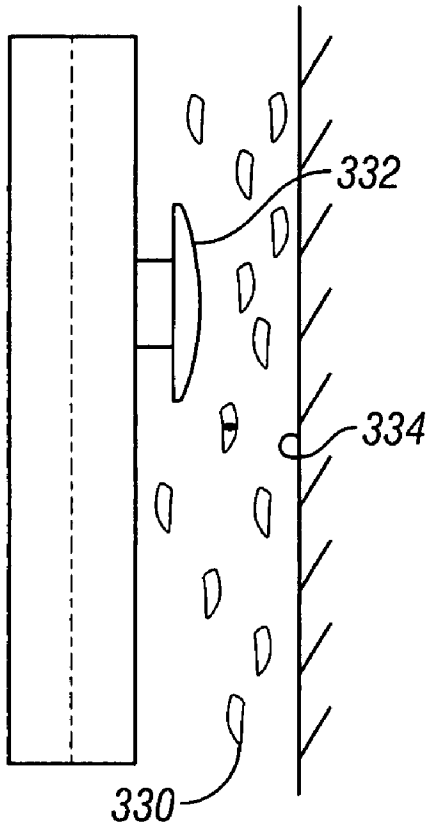

Referring now to FIGS. 3 and 3A–3C, the conceptual aspect of the present invention will be further described. Cuttings 330 usually exist within the well annulus fluid ("return fluid") as shown in FIG. 3A. Some cuttings might become trapped between the sealing pad 332 and borehole wall 334 as shown in FIG. 3B, unless the cuttings are cleared from the intended sealing area. Trapped cuttings are undesirable, because the trapped cuttings can easily degrade the seal between the tool and wall. Likewise undesirable is the possibility that the cuttings can damage the sealing pad, because of the pad is extended with a relatively high force for engaging the wall.

Clearing the sealing area of cuttings is accomplished by flowing clean fluid 336 through the sampling port 338 as the sealing pad is extended toward the wall. As the sealing pad get close to the wall, the flow pressure increases naturally and is sufficient to redirect cuttings away from the sealing area as shown in FIG. 3C. In this manner the sealing area is cleared of potentially damaging cuttings.

Generally the flow of clean fluid through the port is stopped just prior to sealing the pad against the wall. The flow, however, might continue until the pad is fully extended and sealed. In the former case, the system should be configured to automatically close the valve by sensing pressure at the port and to close the valve or switch the valve to its sampling position upon reaching a predetermined pressure. In the latter case, the fluid diverted might be configured to maintain a pressure at the port to avoid damaging the sealing area as the sealing pad is pressed against the wall.

Figure 4:
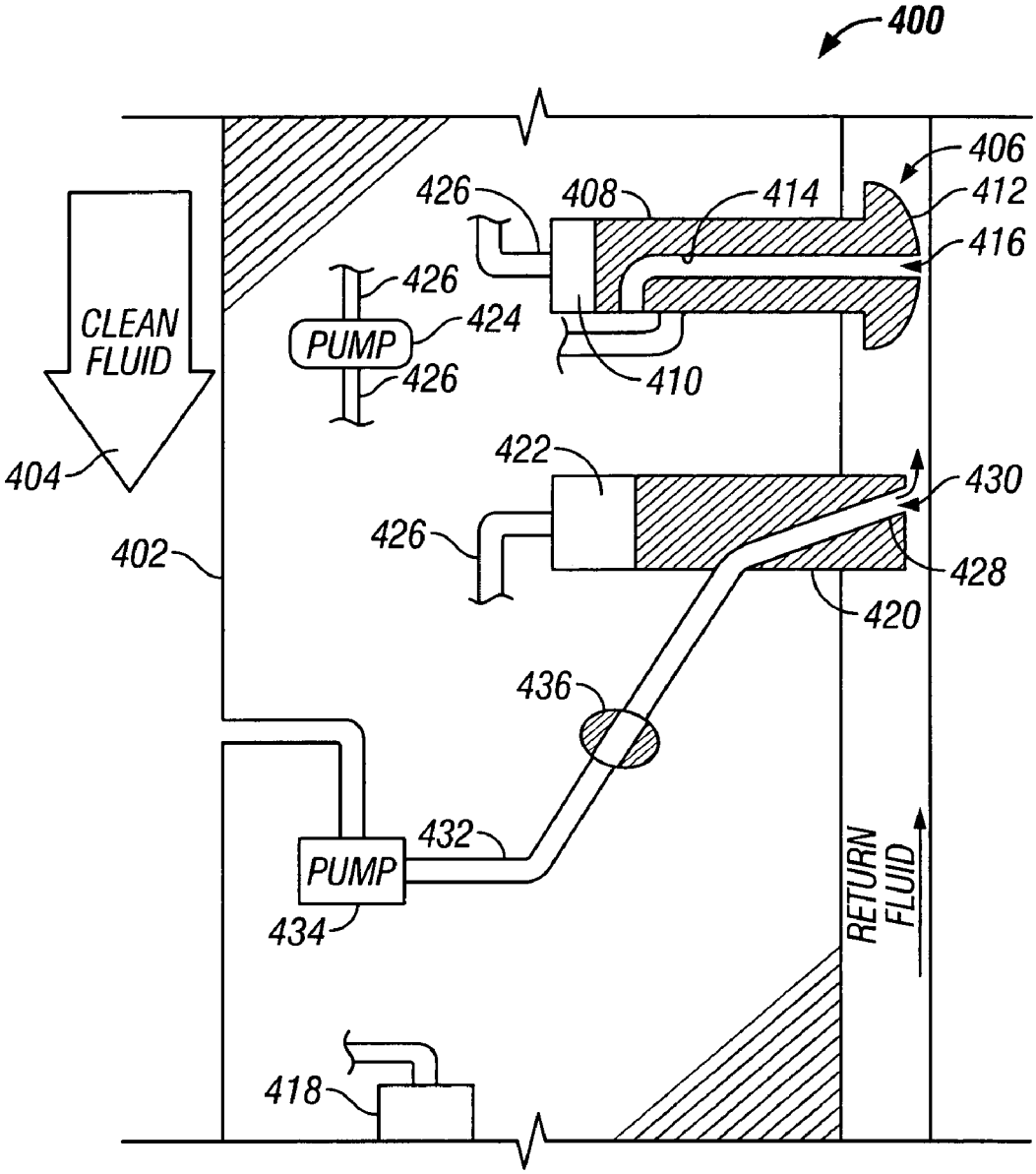
FIGS. 4A and 4B show other embodiments of the present invention wherein the extendable probe of FIG. 4 is an extendable stabilizer blade or a steering rib.

FIG. 4 is a cross section of another embodiment of the present invention wherein an extendable probe is used to direct clean fluid toward a well borehole wall. Shown is one side of a downhole tool 400 having a central bore 402 that allows fluid 404 to flow through the tool. The tool includes an extendable probe 406 having an extendable piston 408 movable within a piston chamber 410 and a sealing pad 412 coupled to one end of the piston. A sample flow line 414 extends from a port 416 at the end of the sealing pad to couple the port to a test and/or sample chamber 418. When extended and sealed against a borehole wall, formation fluid flows from the formation through the probe 406 via the sample flow line 414 for testing downhole or for storage and transport to the surface. Those skilled in the art would understand various known techniques for this type of sampling.

The embodiment shown in FIG. 4 includes a second extendable piston 420 that operates much like the piston 408 of the sampling probe. The second piston 420 is movably housed, in a piston chamber 422 coupled to a piston control pump 424 via a flow line 426. The sample probe piston and the second piston may be operated using a single pump or by separate pumps.

The second piston 420 includes an integral flow path 428 connecting a port 430 at the end of the second piston to a clean fluid flow line 432. The clean fluid flow line 432 extends from the flow path 428 to the central bore 402. A fluid pump 434 and valve 436 are coupled to the clean fluid flow line 432 to direct clean fluid through the clean fluid flow line. The clean fluid is conducted through the flow path 428 and out of the tool through the clean fluid port 430. As shown, the flow path and port are positioned such that the clean fluid exiting the tool is directed toward the borehole wall portion where the sealing pad engages the wall. In this manner, the clean fluid thus directed to clear the sealing area of cuttings or to remove mudcake as the sealing pad is extended to engage the wall.

The present embodiment does not require, and should not be construed as requiring, simultaneous extension of the sampling probe and second piston. These two elements might extend and retract simultaneously, the second piston might be extended first, or the sampling probe might be extended first to a position (as shown) without fully engaging the wall, and then move to sealingly engage the borehole wall after the wall portion is cleared of cuttings.

Figure 4A:
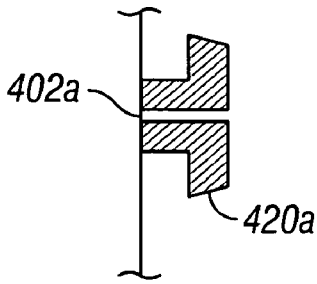
Figure 4B:
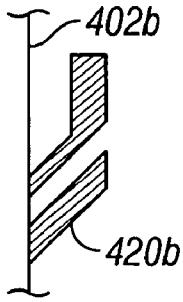

Those skilled in the art would understand that the scope of the embodiment described above and shown in FIG. 4 would include other extendable devices for extending the clean fluid port toward the borehole wall. For example, the second piston 420 could be a gripper 420 as shown. As shown in FIGS. 4A and 4B, the second piston 420 might alternatively be an extendable stabilizer blade 420*a* or an extendable steering rib 420*b*. These devices are known in the art and do not require further description here. These known devices can be readily adapted to include a flow path 428 and clean fluid port 430 to accomplish the results of the present invention.

Figure 5:
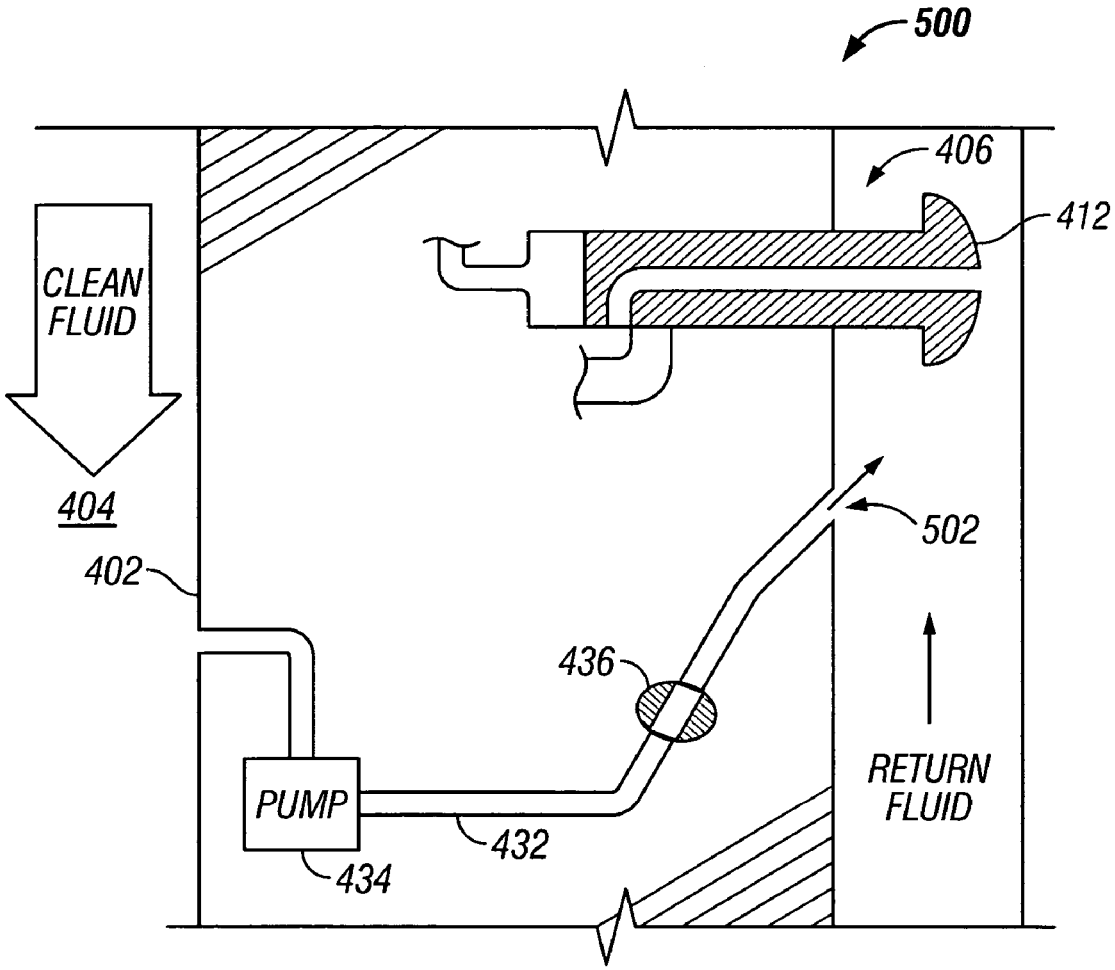
FIG. 5 is a cross section of another embodiment of the present invention wherein clean fluid is directed toward a well borehole wall from a port on a drill string.

FIG. 5 is a cross section of another embodiment of the present invention wherein clean fluid is directed toward a well borehole wall from a port on a drill string. FIG. 5 shows an embodiment of the present invention substantially similar to the embodiment of FIG. 4 with the exception of the second extendable piston. Also, those components substantially identical to like components described above and shown in FIG. 4 have reference numerals as shown in FIG. 4. Some components shown in FIG. 4 are not shown in FIG. 5. These not-shown components are nonetheless considered part of the embodiment of FIG. 5.

The embodiment of FIG. 5 includes a clean fluid flow line 432 extending from a port 502 in the tool 500 to the central bore. As described above and shown in FIG. 4, a pump 434 and control valve 436 are coupled to the clean fluid flow line 432 to divert clean fluid from the central bore to the port. In this manner the clean fluid flow line 432 pump 434 and valve 436 operate as a fluid diverter to divert some or all of the clean fluid to exit the tool at the clean fluid port to clear cuttings from the borehole wall.

The clean fluid flow line 432 and the port 502 are positioned such that clean fluid exiting the tool is directed toward the borehole wall where the sealing pad 412 will engage the wall. In this manner, the clean fluid will clear the sealing area of cuttings as the sampling probe 406 extends to engage and seal against the borehole wall.

Figure 6A:
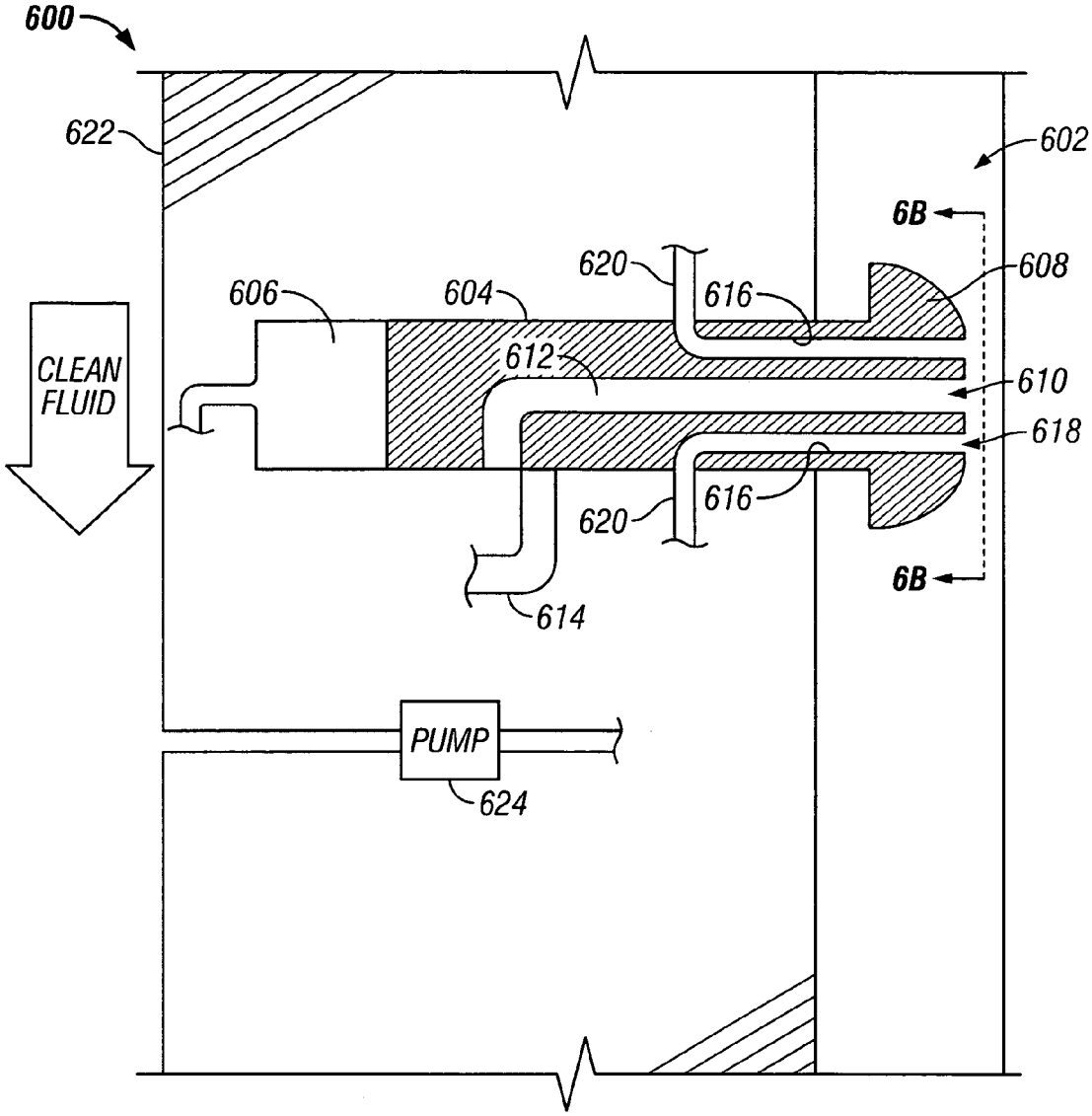
FIGS. 6A and 6B show another embodiment of the present invention wherein clean fluid is directed toward a well borehole wall through additional ports on an extendable probe that includes a sampling port.
Figure 6B:
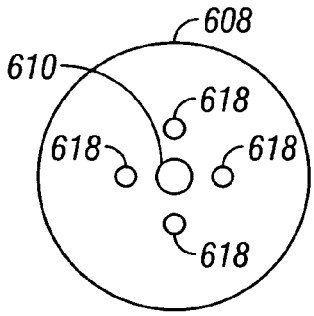

FIGS. 6A and 6B show another embodiment of the present invention wherein clean fluid is directed toward a well borehole wall through additional ports on an extendable probe that includes a sampling port. Shown is a tool 600 disposed within a well borehole adjacent a fluid-bearing formation. The tool of this embodiment includes an extendable probe 602. The extendable probe includes a piston 604 movable within a piston chamber 606 and a sealing pad 608 coupled to an end of the piston. A sampling port 610 leads to a flow path 612 integral to the probe. The flow path 612 couples to a sample line 614 once the probe fully extends to engage the borehole wall.

The extendable probe 602 includes additional integral flow paths 616 leading to one or more clean fluid ports 618 surrounding the sampling port. The integral flow paths 616 couple to corresponding clean fluid flow lines 620 when the probe is extended through an intermediate position (as shown) prior to its fully extended position. The clean fluid flow lines 620 lead from the integral flow paths 616 to the tool central bore 622. A pump 624 is coupled to the clean fluid flow lines to urge clean fluid through the clean fluid flow lines and through the integral flow paths, when the extendable probe moves through the intermediate position.

Figure 7:
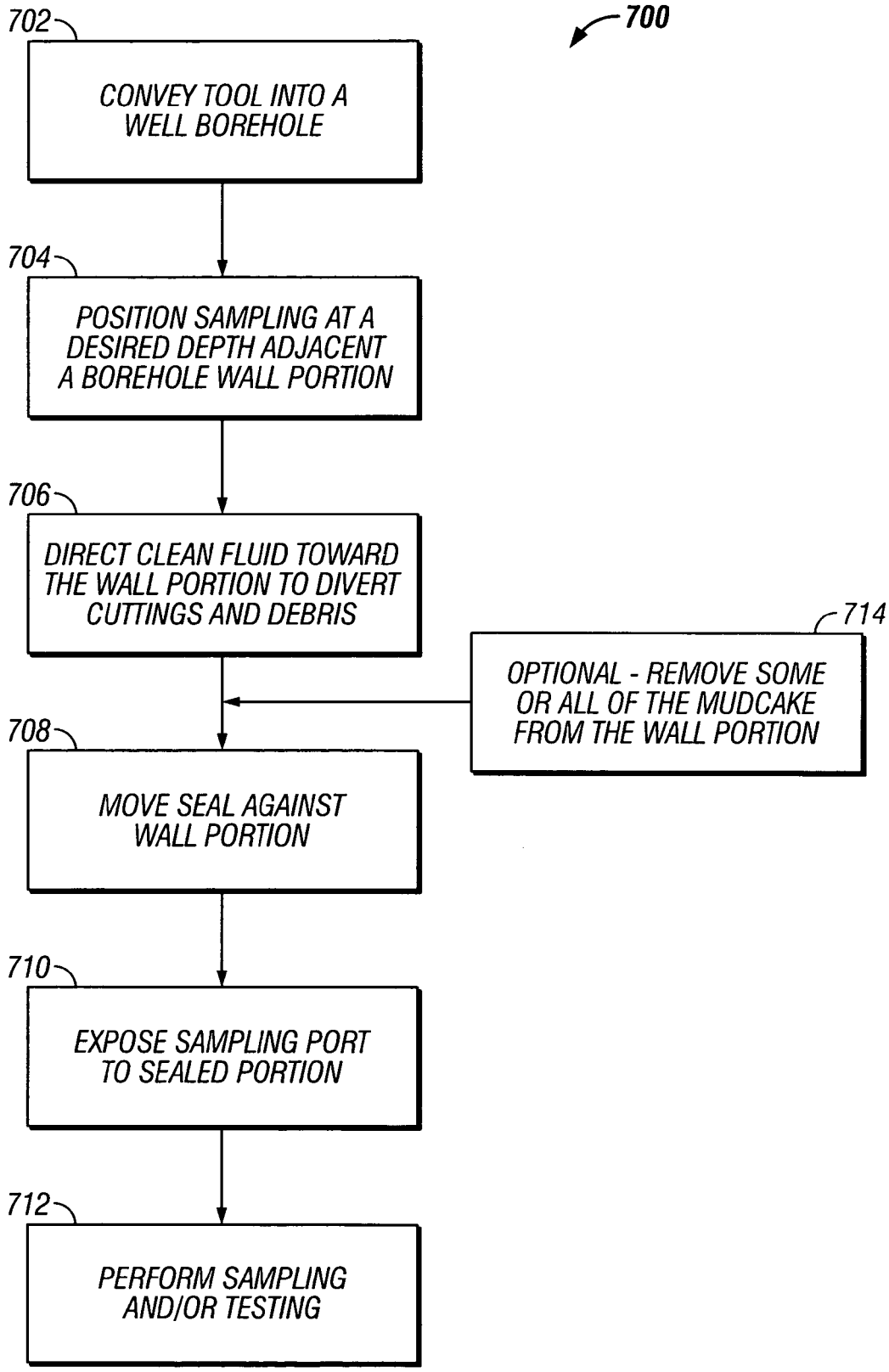
FIG. 7 is a flow diagram of a method according to the present invention.

FIG. 7 is a flow diagram of a method 700 according to the present invention. The method of the present invention can be practiced using any apparatus of the present invention described above and shown in FIGS. 1–6B. The apparatus embodiments should not, however, be construed as limiting the methods to the apparatus described.

A tool is conveyed 702 into a well borehole containing a combination of formation fluid and debris such as cuttings generated during drilling of the borehole. The tool is positioned 704 adjacent a formation traversed by the borehole. The method includes flowing a clean fluid 706 through the tool and diverting some or all of the fluid from a main flow path to exit the tool. The fluid is diverted within the tool such that the exiting clean fluid is directed toward a desired location on the well borehole wall to clear the wall area of cuttings.

The method includes moving a seal 708, such as a pad, against the wall location cleared by the clean fluid to seal a portion of borehole wall from the annulus between the tool and wall. A sampling port is exposed 710 to the sealed wall portion and formation fluid is sampled through the port for test and/or storage for transport to the surface.

Those skilled in formation testing have recognized that the mudcake surrounding a borehole sometimes presents flow problems when sampling fluid or when conducting pressure tests. The mudcake may be compacted, thus impeding flow from the formation. In other cases, the mudcake might be too loose to make a good seal. Tools have been developed to overcome these problems by providing a snorkel at the end of a sampling probe. In sampling tools having a probe snorkel, the snorkel is pressed through the mudcake to the formation rock.

The method of present invention can be useful in these snorkel probes as well as the pad seals described herein. An optional method action is to remove some or all of the mudcake 714 in the area where the sampling probe is to engage the borehole wall. The mudcake is removed by flowing the clean fluid at a higher rate from the tool such that the force of the clean fluid flow removes the mudcake completely or partially from the area. This optional action provides the snorkel a pre-bored path through the mudcake so that pressing the snorkel against the formation rock is easier.

In the several embodiments of the apparatus and system of the present invention, the clean fluid diverter 210 includes an integral pressure control device to allow for added pressure to accomplish the above-described optional step 714. The device might be a nozzle-shaped portion to effect faster fluid flow, or the device might be a pump speed controller.

The advantages of removing mudcake are not necessarily limited to tools having a snorkel-ended probe. Removing some or all of the mudcake is useful when using tools having a pad only. When the mudcake is removed prior to engaging the wall with a pad seal, the pad will seal against the formation rock. In this manner, formation fluid flow is not impeded by a compact mudcake. Also, mudcake fragments cannot contaminate fluid samples or clog the tool.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. An apparatus for sampling fluid from a formation comprising:

(a) a tool conveyed on a drill string in a well borehole surrounded by the formation;

(b) a fluid moving device at a surface location coupled to the tool for delivering a first fluid through the tool, the first fluid comprising a drilling fluid, the first fluid exiting the tool at a distal end and returning as a return fluid to the surface location in an annulus between the tool and a borehole wall, the return fluid including the first fluid and formation fragments;

(c) a fluid-diverting device for directing the first fluid from within the tool toward a portion of the borehole wall for diverting the fragments in the return fluid away from the wall portion;

(d) a pad member disposed on the tool, the pad member being moveable in relation to the wall portion for sealing said wall portion from the annulus; and (e) a first port exposed to the sealed wall portion for sampling formation fluid.

2. The apparatus of claim 1, further comprising a pressure control device for controlling pressure of the diverted first fluid to remove at least some mudcake from the wall portion.

3. The apparatus of claim 1, wherein the fluid-diverting device is coupled to the first port and the first fluid is directed toward the wall portion through the first port.

4. The apparatus of claim 1, wherein the tool further comprises at least one second port coupled to the fluid diverting device and the first fluid is directed toward the wall portion through the at least one second port.

5. The apparatus of claim 4, wherein tool further comprises a first extendable probe, the pad being disposed on the extendable probe and the at least one second port is disposed spaced apart from the extendable probe.

6. The apparatus of claim 4, wherein the tool further comprises an extendable member spaced apart from the pad member, the at least one second port being disposed on the extendable member.

7. The apparatus of claim 6, wherein the extendable member is selected from a group consisting of (i) an extendable probe, (ii) an extendable stabilizer blade, and (iii) a steering rib.

8. The apparatus of claim 1, wherein the tool further comprises at least one second port coupled to the fluid diverting device, the first port and at least one second port being disposed on the pad member and the first fluid is directed toward the wall portion through the at least one second port.

9. A formation testing while drilling system comprising:

(a) a drilling rig for drilling a well borehole into the earth, the rig including a mud circulation system for flowing drilling fluid through a drill string;

(b) a tool disposed on the drill string and conveyed in the borehole, wherein the drilling fluid flows through the drill string and through the tool, the drilling fluid exiting the drill string at a distal end and returning as a return fluid to the surface location in an annulus between the drill string a borehole wall, the return fluid including the drilling fluid and formation fragments;

(c) a fluid diverting device in the tool for directing the drilling fluid from within the tool toward a portion of the borehole wall for diverting the fragments in the return fluid away from the wall portion;

(d) a pad member disposed on the tool, the pad member being moveable in relation to the wall portion for sealing said wall portion from the annulus;

(e) a first port exposed to the sealed wall portion for sampling formation fluid; and (f) a surface controller for controlling at least a portion of a drilling operation including formation testing.

10. The system of claim 9, wherein the tool further comprises a pressure control device for controlling pressure of the diverted first fluid to remove at least some mudcake from the wall portion.

11. The system of claim 9, wherein the fluid-diverting device is coupled to the first port and the first fluid is directed toward the wall portion through the first port.

12. The system of claim 9, wherein the tool further comprises at least one second port coupled to the fluid diverting device and the first fluid is directed toward the wall portion through the at least one second port.

13. The system of claim 12, wherein tool further comprises a first extendable probe, the pad being disposed on the extendable probe and the at least one second port is disposed spaced apart from the extendable probe.

14. The system of claim 12, wherein the tool further comprises an extendable member spaced apart from the pad member, the at least one second port being disposed on the extendable member.

15. The system of claim 14, wherein the extendable member is selected from a group consisting of (i) an extendable probe, (ii) an extendable stabilizer blade, and (iii) a steering rib.

16. The system of claim 9, wherein the tool further comprises at least one second port coupled to the fluid diverting device, the first port and at least one second port being disposed on the pad member and the first fluid is directed toward the wall portion through the at least one second port.

* * * * *